US005743068A

United States Patent [19]

Madariaga

[11] Patent Number: 5,743,068

[45] Date of Patent: Apr. 28, 1998

[54] CITRUS FRUIT PACKING MACHINE

[75] Inventor: Javier Madariaga, Guipuzcoa, Spain

[73] Assignee: Engranajes Ekin, S.A., Spain

[21] Appl. No.: 686,736

[22] Filed: Jul. 26, 1996

[30] Foreign Application Priority Data

Nov. 24, 1995 [ES] Spain ..... 9503006 U

[51] Int. Cl.[6] ..... B65B 3/04; B65B 5/10; B65B 25/04; B65B 35/00

[52] U.S. Cl. ..... 53/247; 53/494; 53/537; 99/356; 99/484; 99/485

[58] Field of Search ..... 99/356, 357, 484, 99/485, 487; 53/247, 255, 261, 443, 448, 475, 494, 69, 505, 537, 538, 240, 244, 245

[56] References Cited

U.S. PATENT DOCUMENTS

| | | | |
|---|---|---|---|
| 3,590,551 | 7/1971 | Riddington et al. | 53/494 |
| 3,882,769 | 5/1975 | Weber et al. | 99/484 |
| 4,329,831 | 5/1982 | Warkentin et al. | 53/537 |
| 4,836,098 | 6/1989 | Shah | 99/360 |
| 4,981,008 | 1/1991 | Ott et al. | 53/247 X |
| 5,457,933 | 10/1995 | LaVars et al. | 53/247 |
| 5,520,941 | 5/1996 | Oosterling | 99/467 |

*Primary Examiner*—Timothy F. Simone
*Attorney, Agent, or Firm*—Bierman, Muserlian and Lucas

[57] ABSTRACT

Citrus fruit packing machine, consisting of a framework structure, in front of which corresponding endless conveyors converge at an angle, respectively holding the citrus fruits and the boxes that are going to contain them; a first head, mounted on said framework structure and with means for guided motion in relation thereto on a vertical plane; a second head, mounted on said first head and with means for linear motion in relation to the former on a horizontal plane and possessing set of cups for taking shipments of citrus fruits from their endless conveyor and depositing them in orderly fashion in the corresponding box, without the possibility that citrus fruits of the same shipment might rub against each other by direct contact.

6 Claims, 5 Drawing Sheets

FIG. 1
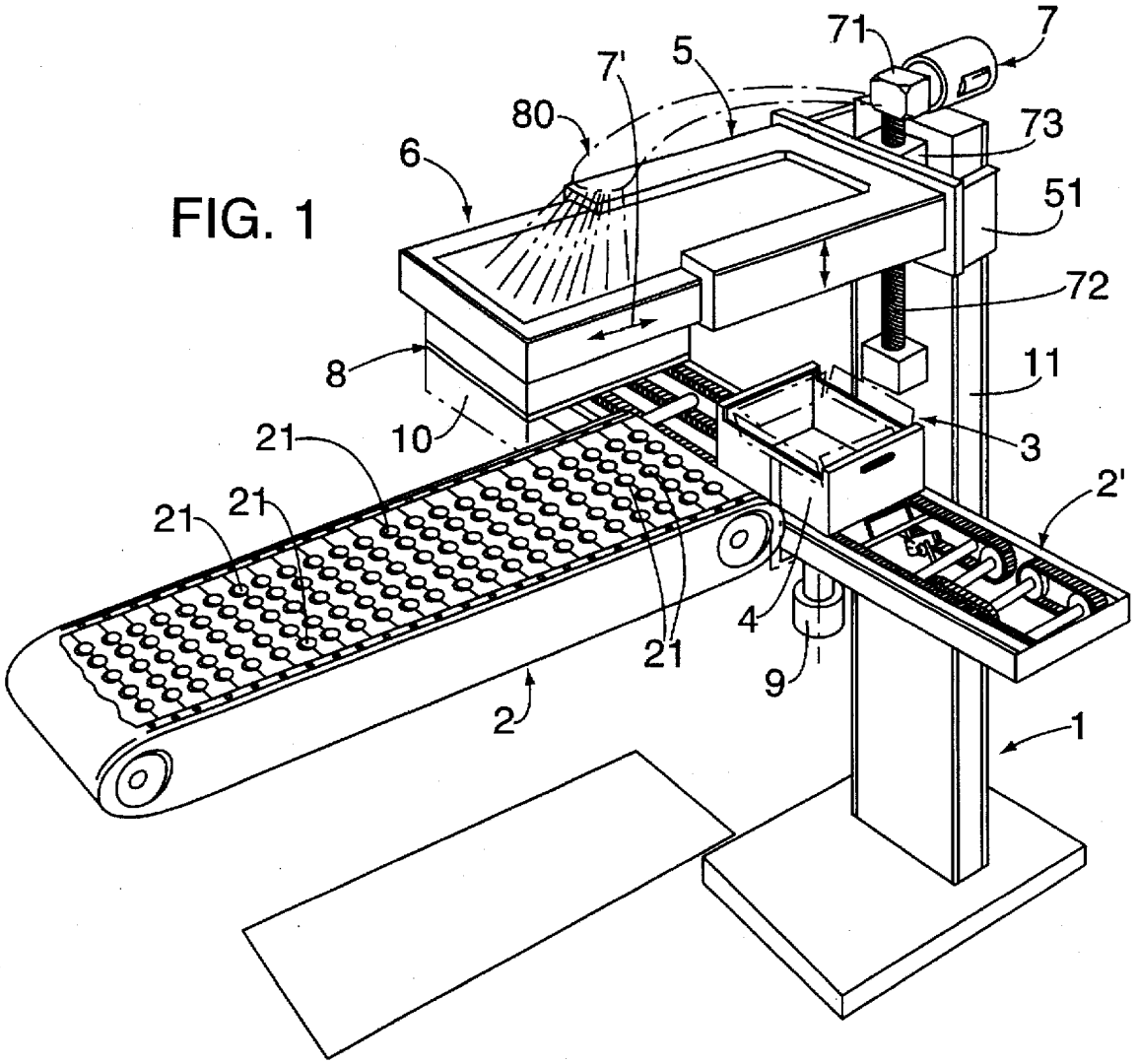
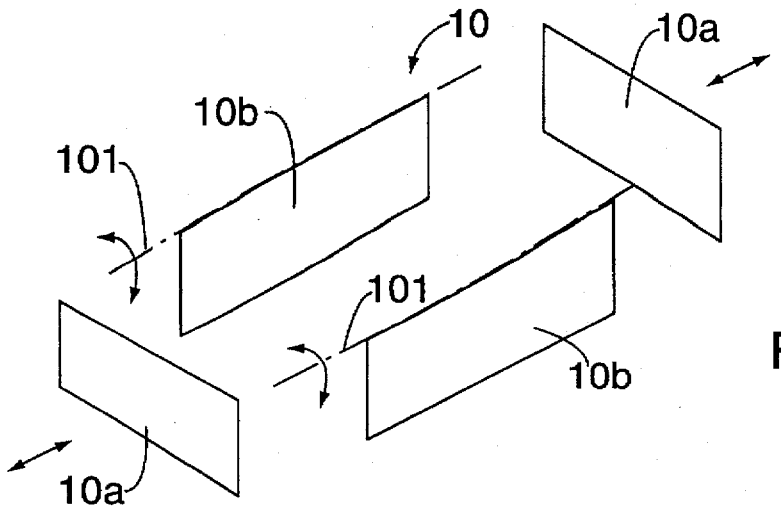
FIG. 10

CITRUS FRUIT PACKING MACHINE

BACKGROUND OF THE INVENTION

1. Field of the Invention

This invention is an application of the industrial handling of products for arrangement in boxes, with a view to their subsequent sale to either wholesalers or retailers.

The invention is mainly applicable in the industrial handling of citrus fruits (such as tangerines, oranges, lemons and the like), although its application is not ruled out for industrial handling of other products which, like those mentioned, present the urgent need to avoid contact, rubbing or friction with each other during the packing operations, in order to prevent spoilage or to reduce it to a minimum.

2. Description of the Prior Art

Ordinarily, to fulfill these specifications, the packing of this type of product is done manually, which requires excessive human labor and a relatively slow process.

Packing machines for delicate products of the type described, which are intended to substitute for human labor, are already known, although their mechanisms for accomplishing that are overly complex and/or do not cover every possibility that might arise in practice, so that it remains necessary to resort to human labor, at least on some occasions. The machines manufactured by the U.S. firm of SUNKIST GROWERS INC. are examples of the preexisting technology.

SUMMARY OF THE INVENTION

The citrus fruit packing machine, subject of this invention, automates the packing process, taking the citrus fruits individually from an endless conveyor belt and depositing them in a container box, grouped by shipments and without the possibility that citrus fruits of the same shipment will rub against each other by direct contact.

BRIEF DESCRIPTION OF THE DRAWINGS

The way the fruits arrive on their corresponding endless conveyor belt, as well as the way of arranging them in their container box, present, in practice, multiple possibilities, so that a multifunction packing machine capable of covering all of them is required. Machine capacities depending on each concrete need will be used, for which purpose the appropriate sizing and grading mechanisms are incorporated.

FIG. 1 represents a general schematic view of a citrus fruit packer, according to the invention, in a nonlimitative practical embodiment.

On this figure the representation of cams (91*a*) has been omitted.

Figure 8:
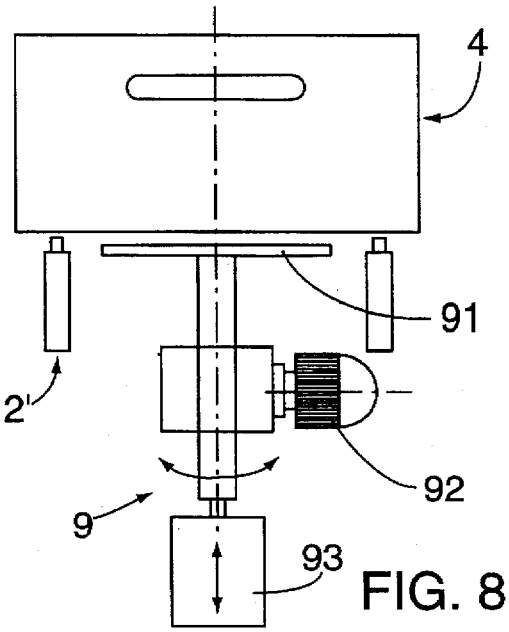

FIG. 8 represents a partial diagram in detail of the means (9) for turning the box (4).

Figure 9:
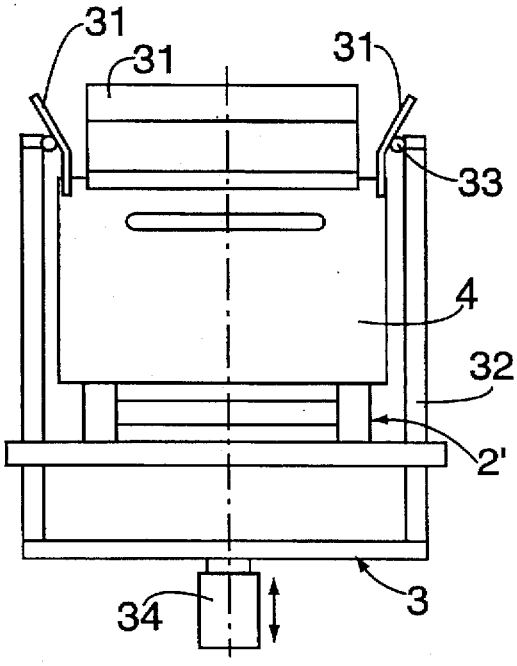

FIG. 9 represents a partial diagram in detail of the means (3) for facilitating entrance of the packing frame (8) placed on the second head.

FIG. 10 represents a working diagram of the tamping clamps (10).

DESCRIPTION OF THE PREFERRED EMBODIMENT

Although the following specification is given with application of the packer, subject of the invention, to citrus fruits (21), such limitation is to be understood as a mere practical embodiment, without ruling out its use for packing other products or objects (21) that do not require substantial alteration of the packer.

This invention concerns a citrus fruit packer, whose basic structure—represented on FIG. 1—includes a framework (1), on which converge corresponding endless conveyor belts (2), (2'), respectively carrying the citrus fruits (21) to be packed and the boxes (4) that are going to hold them.

The convergence of the conveyor belts (2), (2') takes place at any angle, although for sake of structural simplification a 90° convergence has been represented on FIG. 1.

The citrus fruits (21) are arranged in orderly fashion—without contact with each other—, advancing on the endless conveyor (2), which is driven by its own means (not specified, being already known).

The boxes (4), for their part, advance in orderly fashion and in sequence on endless conveyor (2'), being placed at the convergence with endless conveyor (2), in order to be loaded with citrus fruits (21), using the packer, subject of the invention.

The packing machine, subject of the invention, further includes a first head (5) mounted on said framework structure (1) and with means (7) for guided motion in relation thereto on a vertical plane; a second head (6) mounted on said first head (5) and with means (7') for linear motion in relation to the former on a horizontal plane; and means (8) on said second head (6) for taking shipments of citrus fruits (21) from their endless conveyor (2) and depositing them in orderly fashion in the corresponding box (4), without the possibility that citrus fruits (21) of the same shipment might rub against each other by direct contact, and means (9) for making it possible to turn the boxes (4) during loading.

According to the invention, a first head (5), driven by means (7), is guided in a vertical plane on said framework (1).

On said first head (5), a second head (6), driven by means (7'), is guided in a horizontal plane.

This second head (6) in turn contains means (8) for taking shipments of citrus fruits (21) from their endless conveyor (2) and depositing them in the corresponding box (4), using, as the case may be, means—clamps (3), (10)—for tamping such citrus fruits (21), in order to arrange them to occupy minimum space in the box (4).

According to the embodiment represented, the means (7) for guided motion of the first head (5) in relation to the framework (1) are constituted, as can be seen on FIG. 1, by:

- a motor reducer gear (71) and an associated endless screw (72), both mounted on the framework (1);
- a bushing (73), integral with said first head (5) and mounted on the screw (72), so that rotation of the screw

(72) moves the head (5) into sets of guides (11), (51) arranged on the former and into the framework (1).

Likewise, the means (7') for guiding the second head (6) in relation to the first head (5) in a horizontal plane are constituted by a motor reducer which, mounted on one of them—particularly on the first head (5)—transmits a linear motion to the second head (6) by means of at least one pinion combined with pulley or rack.

According to the embodiment represented, the means for taking/depositing shipments of citrus fruits (21) are sets of cups (85) connected to a pressure/vacuum source (80) and mounted on a packing frame (8).

According to the invention and the embodiment represented, the means (8) for taking/depositing shipments of citrus fruits (21) include means for linear movement along at least one of the axes $\overline{OX}$, $\overline{OY}$ of coordinates, as well as for turning in either direction around bearing shafts, in order to obtain, in either case, a folding/unfolding of the sets of cups (85) containing the citrus fruits (21).

Figure 2:
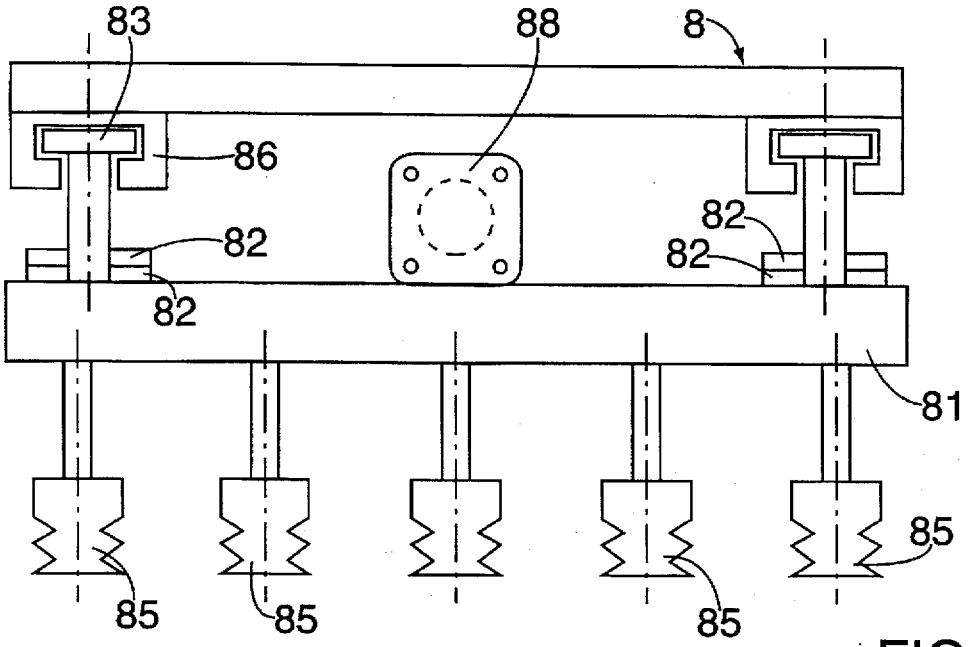
FIG. 2 represents a partial diagram in detail of the packing frame (8).

Means (8) for taking shipments of citrus fruits from one conveyor and depositing them in an orderly fashion in a corresponding box 4 is shown as a packing frame which consists—see FIG. 2—of a multiple number of crosspieces (81), on which the cups (85) are mounted.

The assembly is mounted sliding on upper guides (86), using bearing shafts (83) mounted on at least two crosspieces (81).

Figure 3:
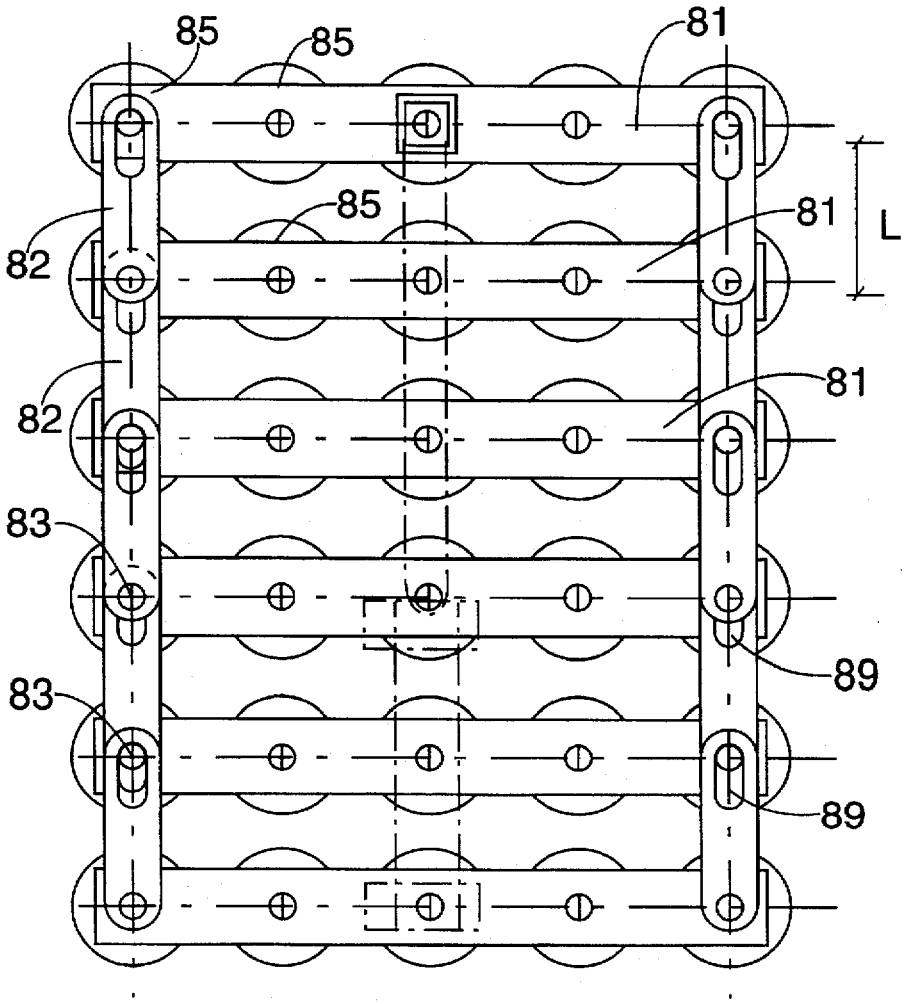
FIG. 3 represents a general plan view of the packing frame (8), corresponding to the previous figure, in unfolded position.
Figure 4:
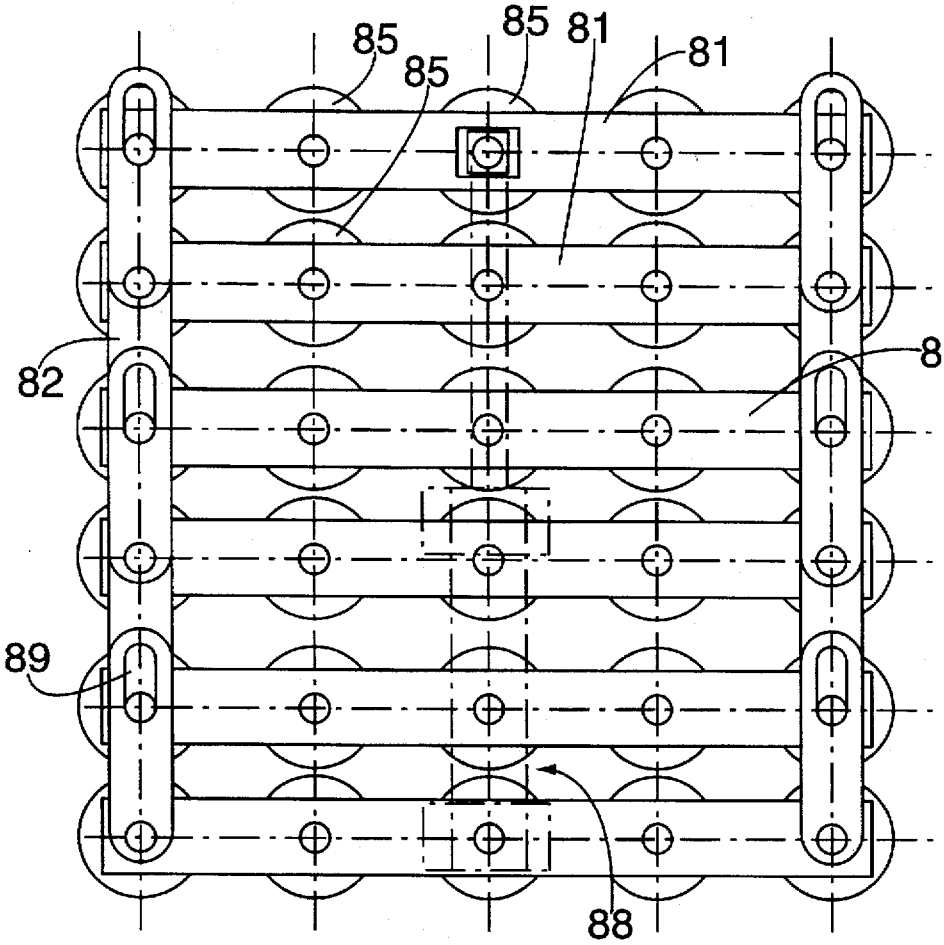
FIG. 4 represents a general schematic plan view similar to the previous figure, for a folded position.

According to the embodiment represented on FIGS. 2 to 4, the cup-bearing crosspieces (81) are joined to each other by connecting rods (82). Each connecting rod (82) has a length (L) with corresponding longitudinally aligned holes, at least one (89) of which is slotted, and they are joined to each crosspiece (81) on a bearing shaft (83).

At least one fluid-action cylinder (88), connected to the frame (8) and to at least one of the crosspieces (81), produces the linear folding/unfolding of the latter along at least one of the axes of coordinates $\overline{OX}$, $\overline{OY}$.

Figure 5:
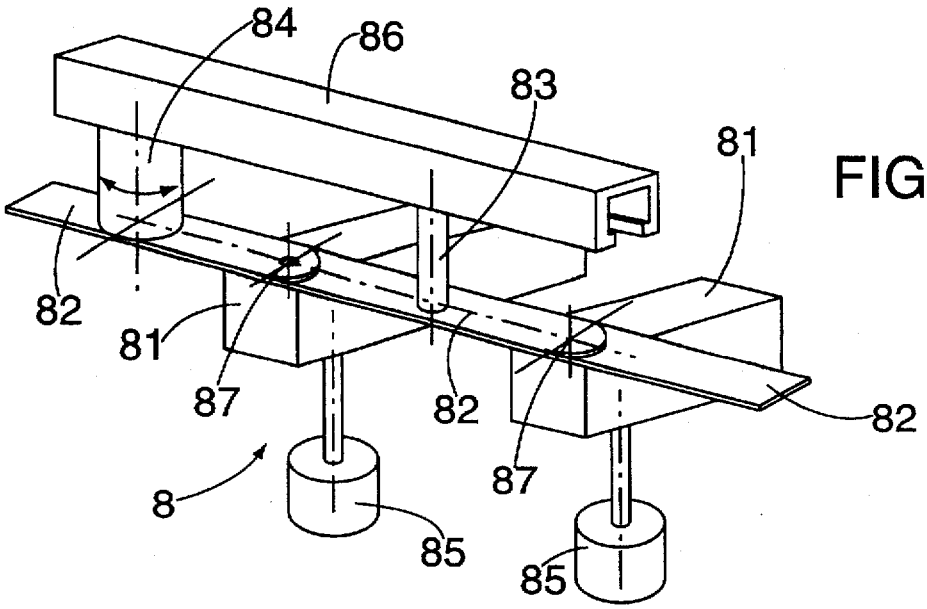
FIG. 5 represents a partial diagram in detail of the packing frame (8) and its means of operation.
Figure 6:
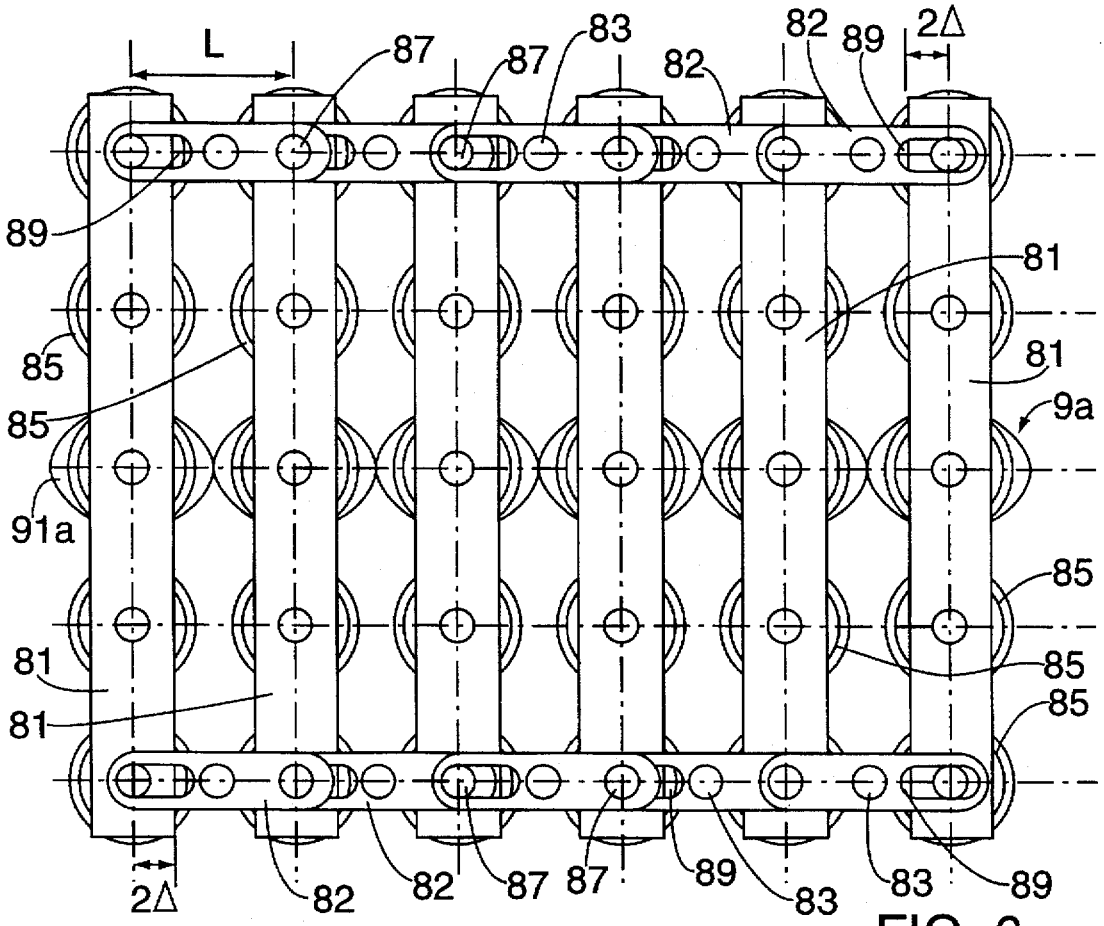
FIG. 6 represents a general schematic plan view of the packing frame (8) with the antifriction means (9*a*) incorporated and in position corresponding to the reception of citrus fruits (21) from their corresponding endless belt (2).
Figure 7:
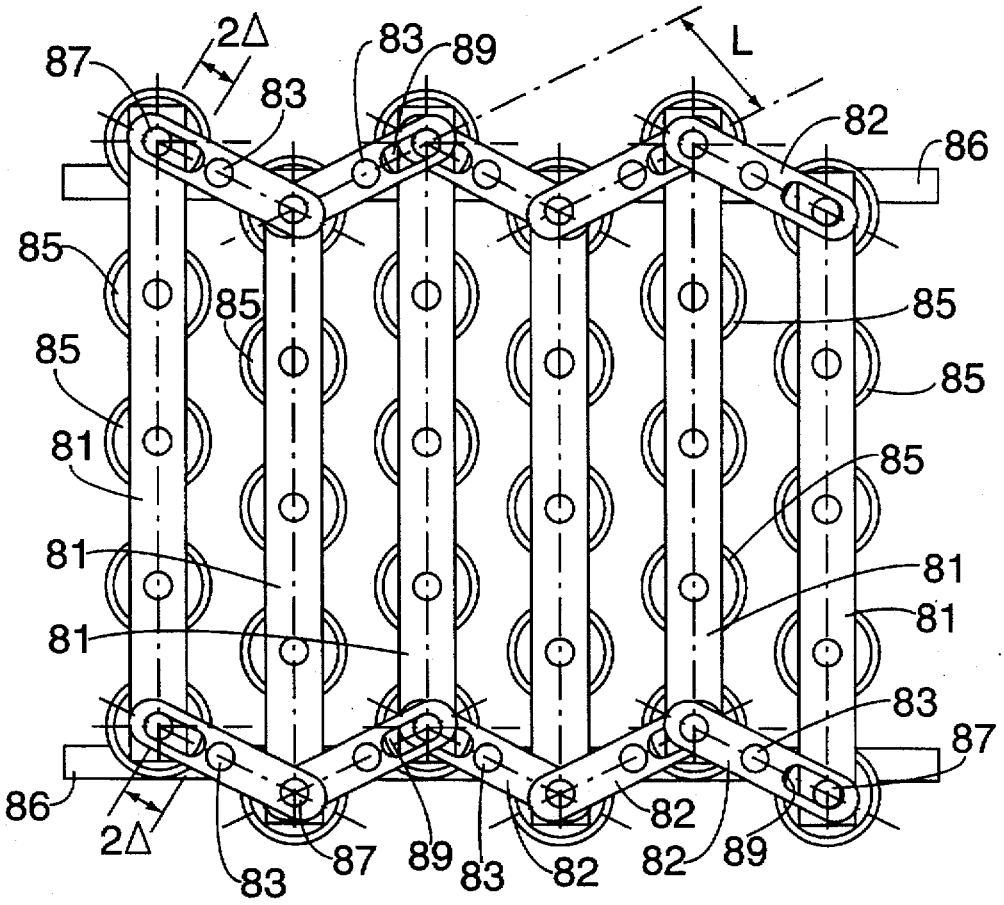
FIG. 7 represents a general schematic plan view, similar to the previous figure, but for a position that is related to the arrangement of citrus fruits (21) in their container box (4), that is, in staggered parallel rows.

If, in addition, or instead of the structure described, at least one (84) of the bearing shafts (83) is driving and is connected fixed to at least one of the connecting rods (82) in its middle area, as represented on FIGS. 5 to 7, said connecting rods (82) can turn in either direction, thus producing the folding/unfolding of the cup-bearing crosspieces (81).

In this case, provision is made for the inclusion of antifriction means (9*a*) which, for the embodiment represented, are constituted by spacing cams (91*a*) mounted in positional correspondence, with at least one on each crosspiece (81), in order to rub together in pairs on any motion of the frame (8), tending to keep apart the crosspieces (81)—and, consequently, the cups (85) and corresponding citrus fruits (21) they carry—in conjunction with the slotted holes (89) that provide the play for the joints (87) between connecting rods (82).

Each spacing cam (91*a*) starts from a circular configuration of diameter $\emptyset_1$ and forms corresponding diametrically opposite widenings, each of width $$\Delta = \frac{\phi_1 - L}{2},$$

with $\emptyset_1$=minimum diameter of the cam, coinciding with the diameter of the citrus fruit (21) to be packed.

L=length of the connecting rods (82).

2Δ=width of the slotted holes (89).

According to the embodiment represented, the said means (9) for turning the boxes (4) consist—see FIG. 8—of a turntable (91) associated with a motor reducer (92) and a pneumatic lifting piston (93).

This assembly is protected by the endless conveyor (2') which, for the embodiment represented, is a chain conveyor.

The means for facilitating entrance of the citrus fruits (21) in the box (4) to be loaded are:

a) in the said box-holding endless conveyor (2'), corresponding side entrance cards (31) mounted on a rigid support (32), with the possibility of swinging around a pin (33). The rigid support (32) is raised/lowered by a pneumatic piston (34) in synchronized action with the rest of the packer, according to the diagram of FIG. 9;

b) on the aforementioned second head (6), tamping clamps (10) arranged in pairs, of which two (10*a*), facing, are movable toward or away from each other, while the other two (lO*b*) are mounted with the possibility of swinging around a pivot (10*b* ), according to the diagram of FIG. 10.

The citrus fruit packing machine of the invention is completed with means that control (permit or stop), at will and independently, the operation of these mechanisms, offering multiple possibilities of packing fruits. Thus:

a) by keeping the position of the box (4) fixed in relation to its endless conveyor belt (2'), it is possible to use a packing frame (8) with connecting rods (82) linearly movable or with connecting rods (82) capable of turning. The first mechanism will be used when the first and last rows of the corresponding layer include the same quantity of citrus fruits (21);

b) by turning the box (4) in relation to its conveyor belt (2'), it is possible to use a packing frame (8) with connecting rods (82) linearly movable or with connecting rods (82) capable of turning. The box (4) will be turned when, on using a packing frame (8) with linearly movable connecting rods, the first and last rows of the corresponding layer include a different quantity of citrus fruits (21).

I claim:

1. A citrus fruit packing machine positioned at a convergence between two endless conveyors, wherein one conveyor holds citrus fruit and the other conveyor holds a box into which said citrus fruit is packed by said citrus fruit packing machine, said citrus fruit packing machine comprising:

(a) a framework structure;

(b) a first head movably attached to said framework structure and positioned above said endless conveyors; said first head having a means for guiding and moving said first head in a vertical plane;

(c) a second head movably attached to said first head, said second head having a means for guiding and moving said second head in a linear manner in a horizontal plane;

(d) a lifting and depositing means for lifting said citrus fruit from said one conveyor and depositing said citrus fruit in said box, said lifting and depositing means comprising:

(d1) a frame attached to said second head;

(d2) at least two cup-bearing crosspieces movably connected to each other by means of spacer rods;

(d3) bearing shafts movably connecting said cup-bearing crosspieces to said frame;

(d4) a set of cups mounted to said cup-bearing crosspieces; and (d5) a means for moving said cup-bearing crosspieces in both an X-axis and a Y-axis in a horizontal plane;

(e) a box-holder means for holding and rotating said box 180° during packing of said box, said box holder means positioned below said box; and (f) means for facilitating the tamping entrance of said citrus fruit into said box during packing so as to pack said citrus fruit in said box in an orderly fashion.

2. The citrus fruit packing machine of claim 1 wherein said spacer rods have two corresponding longitudinally aligned holes, one at each end of said spacer rod, each hole being rotatably attached to an adjacent cup-bearing crosspiece, at least one of said holes being longitudinally slotted to allow for folding/unfolding movement of said cup-bearing crosspiece.

3. The citrus fruit packing machine of claim 1 wherein said means for moving said cup-bearing crosspieces is a driver which is mounted on one of said bearing shafts.

4. The citrus fruit packing machine of claim 1 wherein said means for moving said cup-bearing crosspieces is at least one fluid action cylinder.

5. The citrus fruit packing machine of claim 1 wherein said box holder means comprises: a pneumatic lift cylinder connected to a turntable upon which said box sits during packing and a motor reducer connected to said turntable to rotate said turntable during packing of said box.

6. The citrus fruit packing machine of claim 1 wherein said means for facilitating the tamping entrance of said citrus fruit into said box comprises:

(a) a side entrance card assembly, comprising four side entrance cards, one corresponding to each side of said box, said side entrance cards being swing mounted on a frame, said frame connected to a pneumatic piston for raising and lowering said frame, said side entrance card assembly positioned at said box on said other conveyor; and (b) a tamping clamp assembly comprising tamping clamps arranged in opposite pairs and movable towards and away from each other, said tamping clamps mounted on said second head.

* * * * *